United States Patent [19]

Lang

[11] Patent Number: 4,648,677

[45] Date of Patent: Mar. 10, 1987

[54] ELECTRICAL CONNECTOR ASSEMBLY AND METHOD FOR TERMINATING CABLE

[75] Inventor: Roger J. Lang, Garden Grove, Calif.

[73] Assignee: Allied Corporation, Morristown, N.J.

[21] Appl. No.: 740,096

[22] Filed: May 31, 1985

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS

| | | | |
|---|---|---|---|
| 3,054,081 | 9/1962 | Bertram et al. | 339/103 M |
| 3,176,261 | 3/1965 | Greco et al. | 339/176 |
| 3,324,445 | 6/1967 | Miller | 339/171 |
| 3,509,513 | 3/1970 | Russin | 339/14 |
| 3,794,959 | 2/1974 | Kamotz | 339/103 M |
| 3,838,388 | 9/1974 | Wilbur et al. | 339/75 P |
| 3,907,396 | 9/1975 | Huber | 339/103 R |
| 4,006,957 | 2/1977 | Narozny | 339/99 R |
| 4,009,921 | 3/1977 | Narozny | 339/99 R |
| 4,130,334 | 12/1978 | Anderson | 339/103 M |
| 4,153,325 | 5/1979 | Asick | 339/99 R |
| 4,188,083 | 2/1980 | Knowles | 339/99 R |
| 4,190,952 | 3/1980 | Thomas et al. | 339/99 R |
| 4,192,571 | 3/1980 | Strutz | 339/103 M |
| 4,209,217 | 6/1980 | Gudaitis et al. | 339/75 MP |
| 4,220,390 | 9/1980 | Cobaught et al. | 339/97 R |
| 4,269,466 | 5/1981 | Huber | 339/107 |
| 4,295,704 | 10/1981 | Narozny et al. | 339/99 R |
| 4,296,989 | 10/1981 | Larson et al. | 339/99 R |
| 4,358,177 | 11/1982 | Badolato | 339/103 M |

FOREIGN PATENT DOCUMENTS

| | | | |
|---|---|---|---|
| 722149 | 6/1972 | Japan | 339/103 M |

*Primary Examiner*—Joseph H. McGlynn
*Attorney, Agent, or Firm*—C. D. Lacina

[57] ABSTRACT

Two pairs of a first cover (52,53) mounted over a second covers (62,63) captivate and strain relieve respective flat wire cables upon the wires being passed between the respective cover pair and the cover pairs being latched to a connector housing. Respective contacts in the housing are secured therein by a comb (34).

18 Claims, 4 Drawing Figures

ELECTRICAL CONNECTOR ASSEMBLY AND METHOD FOR TERMINATING CABLE

The present invention relates to an electrical connector assembly and method for terminating cable, and more particularly to strain relieving the termination and securing contacts in a connector.

A previous arrangement for terminating ribbon cable is shown by Asick U.S. Pat. No. 4,153,325 "Method and Connector for Terminating Twisted Pair and Ribbon Cable" and includes a comb-like member wherein an individual conductors thereof are laced to the comb. Such a method could be time consuming and not provide a suitable strain relief arrangement.

The present invention includes a multi-contact connector for terminating cable, and in particular, terminating flat ribbon-type cable, the connector assembly including a housing having a bottom mating face, a top terminating face, an array of passages extending between the faces, and an L-shaped contact carried in each passage. In particular, the assembly includes a stuffer/comb having spaced fingers that fills each passage retention ledge, a cover arrangement that strain relieves the termination, and a latch arrangement that secures the strain relieved termination. Each L-shaped contact is acuately angled, notched medially of its ends, and provided with a dimple. After insertion of these contacts into their respective passages from the bottom mating face, the contact is seated on a retention ledge and bears against the passage wall. In one embodiment, the contact terminates in a slot forming a solderless insulation displacing contact. In another embodiment, the contact terminates in a slot which is soldered to a coaxial-type cable.

A plastic contact cavity stuffer/comb has its respective fingers inserted into each respective passage from the top terminating face downwardly to fill the passage between the retention ledge and opposite passage wall and individual comb fingers drive against respective of the dimples. The dimples serve to retain the comb in the connector.

A strain relief arrangement protects the cable termination from forces tending to disturb the interconnection. In one embodiment, two pairs of a first cover mount over a second cover, the cover pairs then being mounted in a side-by-side relation whereby to form a wire receiving slot between the two cover pairss. In an alternate embodiment a strain relief comb is disposed between a pair of sidewalls with each sidewall captivating discrete coaxial cables in recesses defining the comb, the comb and sidewall assembly forming a cavity above the terminating portions of the contacts with the contacts being soldered to the wires and the cavity being filled with an epoxy to protect the wires.

BRIEF DESCRIPTION OF THE DRAWINGS

Referring now to the drawings, FIG. 1 shows a multi-contact electrical connector assembly for terminating two multi-conductor flat ribbon cables 74, the assembly including an elongated base member 12 having a bottom mating face 14, a top wire terminating face 16 and a plurality of terminal receiving passages 18 extending between the faces with an L-shaped contact 22 disposed in each respective passage, each passage including a retention ledge 20, and each contact being acutely angled and including a body 24, a first mating end 26 comprising a foot (the bottom of the "L") and a second mating end 28 comprising a slotted insulation piercing portion extending above the terminating face, a cover arrangement for captivating the cables to strain relieving their termination, and an arrangement for retaining the contacts within the respective passages. The housing has opposite ends 42,44 with each having retention pads 46.

Figure 2:
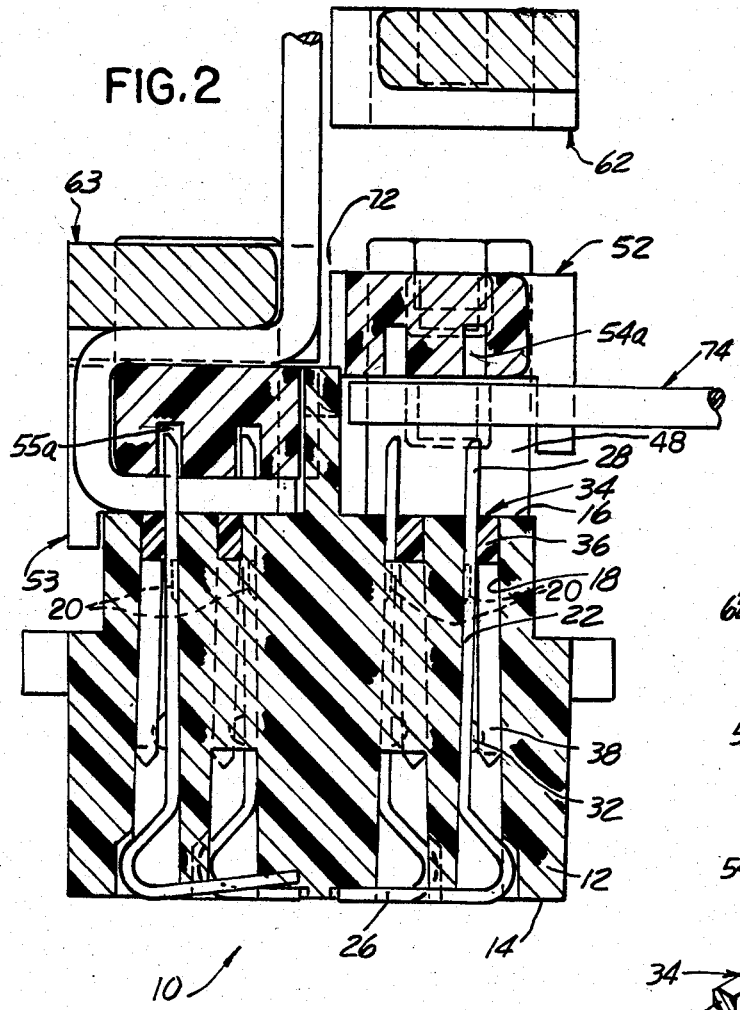
FIG. 2 is a section view of the connector assembly shown in FIG. 1 terminating the conductors of a flat ribbon cable.
Figure 2:
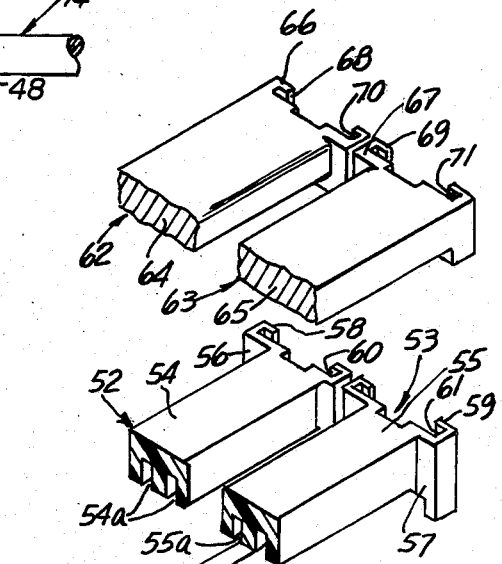
Figure 2:
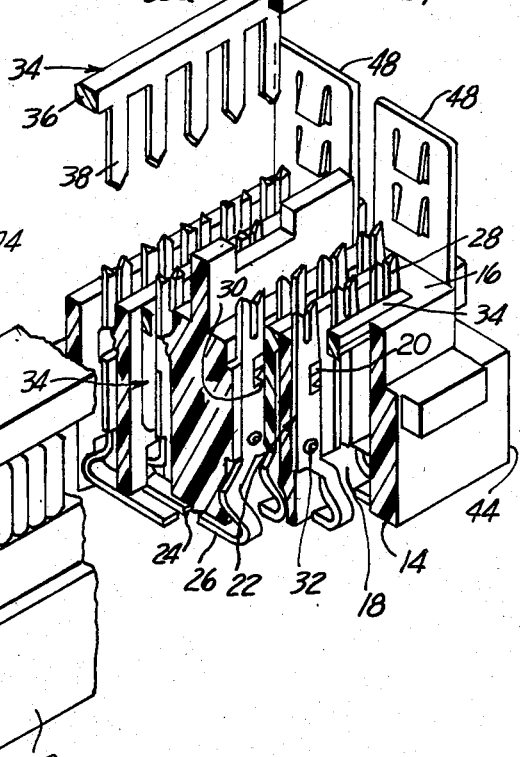

The contacts 22 include a notch 30 and a dimple 32, the notch seating on the retention ledge 20 to position the contact within its passage.

A contact stuffer comb 34 of dielectric material comprises an elongated rail 36 having a plurality of laterally spaced fingers 38 extending downwardly therefrom, each finger being adapted to be inserted into a contact passage and serving to fill the passageway between the retention ledge and other passagewall. As shown, there are four rows of spaced contact receiving passages and four combs. The contact dimple 32 biases against its associated comb finger 38 with the collective bias force serving to retain the comb in the connector housing.

The strain relief arrangement comprises two pairs of covers 52, 62 and 53, 63, each respective pair being adapted to be pressed downwardly onto the terminating face in side-by-side relation whereby to form a slot 72 and to retain a flat wire cable terminated to respective of the contacts. A plurality of latch plates 48 extend upwardly from each end 42, 44 of the base 12, the latch plates for securing the cover members when they have been pressed downwardly about the connector housing, each latch plate 48 including aparatures 50 for fitment into retention pads 46 and resilient tangs 49 for seating onto a shoulder 43 at the end of each cover. The pair of first covers 52, 53 are asymetrically similar (each has its body set closer to the center of the housing when captivated by the latch plate) and each includes an elongated body 54, 55 having a bottom face adapted to be driven downwardly against the cable and profiled with lateral slots **54*a*, 55*a* to receive the insulation piercing portions of the contacts. Each opposite end of the cover includes a flange 56, 57 with an inwardly turned lip 58, 59 to define at each end spaced grooves 60, 61 for slidably fitting downwardly about its respective latch plate. The pair of second covers 62, 63 are also asymmetrically similar each has its body set outward from the center of the housing when captivated by the latch plate) and each includes an elongated body 64, 65 adapted to be driven downwardly towards the first cover to sandwich the ribbon cable therebetween and each terminates in a flange at 66, 67 at each opposite end with like inwardly turned lips 68, 69 to define a groove 70, 71 for similarly being forced downwardly about the latch plate. When each first cover is pushed downwardly, the tang on the latch plate engages a shoulder on the cover wherey to secure the cover. When each second cover is pushed downwardly, the latch plate secures it as well in the same way in that a tang on the latch plate engages a shoulder 43 on the cover. When both the pair of first covers and the pair of second covers have been secured, a slot 72 is defined therebetween for passing the cables 74** upwardly.

Figure 1:
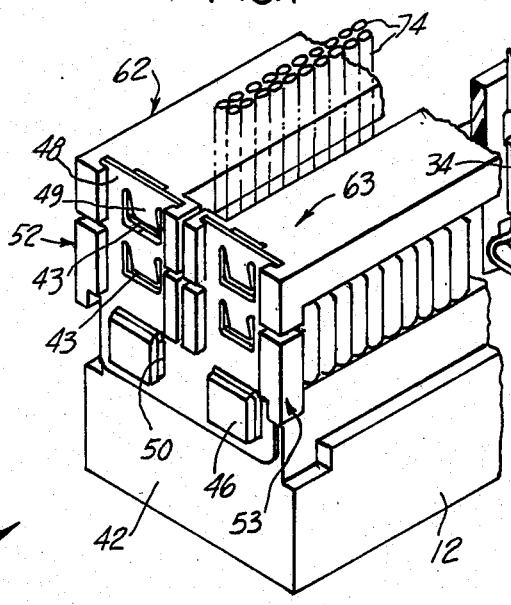
FIG. 1 is a perspective view of a multi-contact connector assembly for termination with a flat ribbon cable.

FIG. 2 shows a section view of the connector assembly of FIG. 1 with one flat ribbon cable 74 terminated (the one to the left) and another flat ribbon cable about to be terminated (the one to the right). Further, the coaction between the end of each finger of the combs 34 pressing against respective dimples 32 on the contacts and the filling of the passages 18 to secure the contacts in their passage is shown. To form the strain relieved interconnection, viewing the assembly to the right, the terminable end portion of the flat ribbon cable is forced downwardly onto the insulation displacing portion of the contacts whereby contact is made with respective conductors inside each wire. The first cover 52 is pushed downwardly and engages the latch plate 48 at each opposite end of the housing whereby to compress the cable against the terminating face 16 and to secure the termination. The ribbon cable is then wrapped upwardly and inwardly (to the left) and then perpendicularly upwards. Thereupon, the second cover 62 is pushed downwardly and to cover arrangement requires the cable to form a "P-shaped" threaded relation. This final relation is shown to the right of FIG. 2 with a cover arrangement using covers 53, 63 and a first cable that has been terminated by the contacts.

Figure 3:
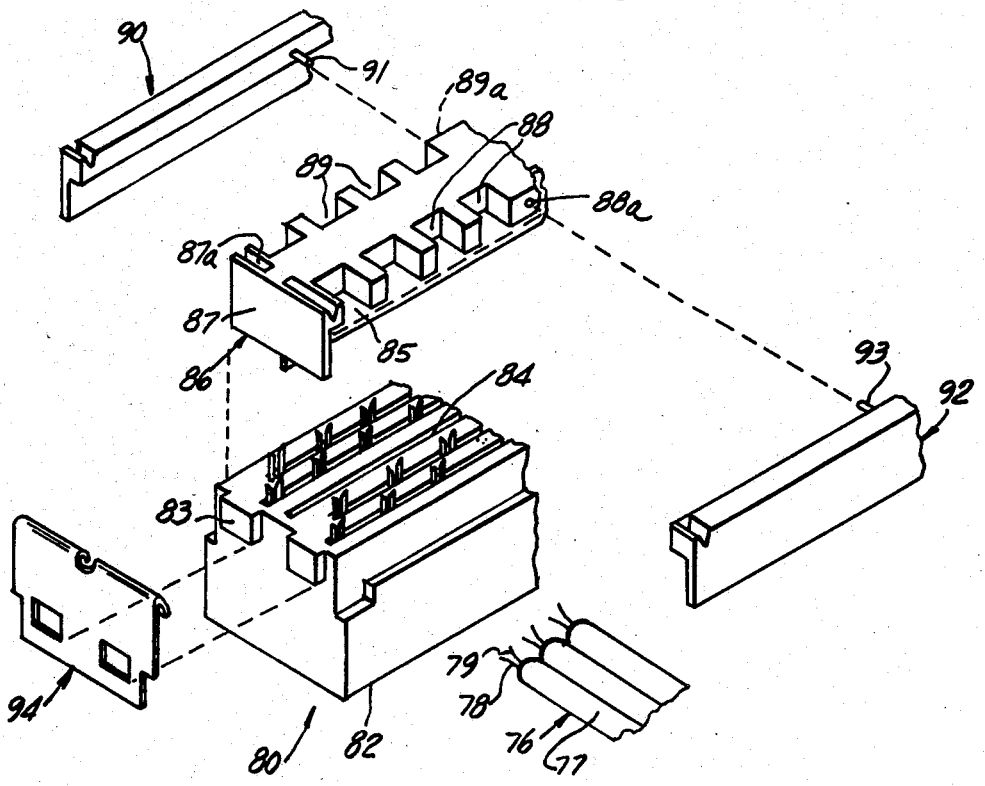
FIG. 3 is an alternate embodiment showing a multi-contact connector assembly for terminating a coaxial-type cable.

FIG. 3 shows an alternate connector assembly 80 wherein a plurality of slotted contact portions extend upwardly from the terminating face of a connector housing 82, the interior connector housing arrangement using a stuffer comb and contacts described above being the same. A purpose of this assembly would be to strain relieve the individual wires of coaxial cable 76 of the type having a conductor 78 and a drain wire 79. The strain relief arrangement includes a pair of L-shaped sidewalls, and a strain relief cover member 86, the cover including a lateral rib 85 sized to fit a lateral groove 84 on the housing, a flange 87 at each end, a detent 87*a* in the flange, a pluality of recesses 88, 89 on each side of the cover to receive individual cables and a pair of locating apertures 88*a*, 89*a*. The sidewalls include pins 91, 93, and detents at each end, the sidewalls being adapted to come together against the cover 86 and secure individual wires in the recesses. A "J" sectioned clip 94 secures into the detents at each end of the sidewalls and secures the three to the connector housing.

Figure 4:
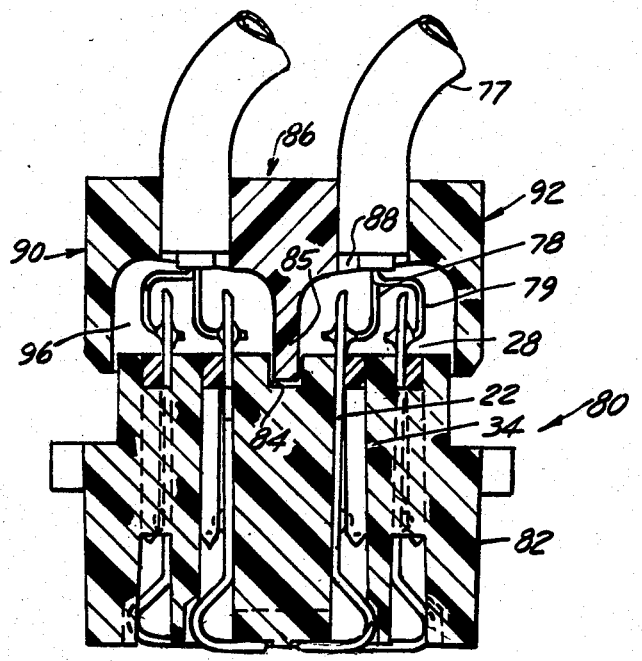
FIG. 4 is a section view of FIG. 3.

FIG. 4 shows a terminated assembly with the coaxial cable wherein the strain relief comb 86 has its rib 85 received in the lateral slot 84 extending along the terminating face of the connector housing, the wires have been disposed within their respective strain relief comb, a drain wire 79 and a conductor 78 soldered to a contact, and the sidewalls secured thereabout. A cavity formed above the terminating face is filled with an epoxy.

For assembly, the cable is prepared by exposing the end portions of the center conductor and drain wire and placed at a right angle to the contact. The conductors are placed into the slot in adjacent of the contact paris and soldered thereto. The center strain relief 86 with clips is then positioned about the cables and the "J" clip is heat-staked to the end of each housing to form a molded interference fit therewith. The cavity is filled with an epoxy bond to maintain the soldered termination.

I claim:

1. A connector for terminating a multi-conductor ribbon cable comprising an elongated base member having a mating-face, a wire terminating face, and a pluality of terminal receiving passages extending between the faces with a terminal disposed in each respective passage, each terminal extending beyond the terminating face, and means for strain relieving the termination, characterized by a pair of stackable first and second covers, and means for latching the covers about the terminating face, each said cover including an elongated body having at each end a pair of lips turned inwardly so as to define a groove, the latch means including four latch plates each extending upwardly from the base member for latching to the lateral end faces of one and the other pair of first and second covers, each plate being received in the spaced grooves whereby the covers may be driven downwardly towards the terminating face such that the second covers define a lateral slot therebetween, the terminated cable having a first portion pressed on the mating face, a second portion perpendicular to the mating face, a third portion sandwiched between the first pair of covers, and a fourth portion extending perpendicularly to the mating face and through the slot.

2. The connector as recited in claim 1, further comprising means for terminating two ribbon cables, the second cable having its like first, second, third, and fourth portions directed in like fashion about the other pair of first and second covers whereby its fourth portion is adjacent to the first cable fourth portion and extends perpendicularly to the mating face through the slot.

3. A method for terminating ribbon cable to an elongated housing having a planar terminating face and a plurality of terminals the insulation piercing portions of which extend upwardly from the terminating face, comprising the steps of:

pressing the terminable end of the cable downwardly onto the piercing portions whereby a respective piercing portion makes electrical connection with a respective conductor in the cable, securing a latch plate to each end of the housing, each plate extending above the terminating face and including a plurality of retention tangs.

pressing an elongated first cover having a bottom face profiled to receive the piercing portions and a shoulder at each lateral end downwardly onto the cable to have each shoulder engaged by one of the tangs thereby securing the cover and the cable to the housing, wrapping the cable at a point rearwardly from its termination upwardly and inwardly over the top face of the cover, pressing an elongated second cover having a second shoulder at each lateral end downwardly onto the cable whereby the respective tangs engage one said second shoulder, directing the cable so that it extends perpendicularly to the connector, and mounting an elongated third cover onto the housing, the third cover having at each end a shoulder which is engaged by one of the tangs on the latch plate, said third cover cooperating with the other covers to define a central slot therebetween for receiving the cable.

4. A method as recited in Claim 3 wherein said method comprises pressing the terminable end of a second cable downwardly onto a second set of piercing portions, said third cover having a face profiled to receive the second set of piercing portions wrapping the second cable rearwardly from its termination and upwardly and inwardly over the top face of the third cover, and pressing an elongated forth cover downwardly upon the second cable, said fourth cover defining a slot therebetween for receiving the first and second cables therethrough.

5. A connector assembly for terminating discrete or ribbon cable, the assembly comprising an elongated dielectric housing having a mating face, a wire terminating face and a plurality of terminal receiving passages each extending between the faces in a first direction, an electrical terminal disposed in each respective passage, and retention means for retaining the terminals in said housing, each terminal including a first end portion adjacent to the mating face, a second end portion adjacent to the terminating face, and a medial portion within its passage, said retention means characterized in that each said passage includes a retention ledge extending a first distance from one passagewall and terminating a second distance from the passagewall opposite thereto, each said medial portion has a thickness substantially the same as said first distance and includes a cutout sized to fit snugly about its retention ledge, and a dielectric passage stuffer is mounted to the housing, said stuffer including an elongated finger extending transversey from a rail with the rail being seated on one said face and the finger being disposed in the passage, said finger having a width substantially the same as said second distance so as to fill the space between the retention ledge and the opposite passagewall.

6. The assembly as recited in claim 5 wherein each said terminal is L-shaped is cross-section and includes a protuberance medially of its end portions, said passage stuffer is integrally formed and comb-like and comprises an elongated rail and a plurality of fingers with each said finger being laterally spaced along a like face of the rail and extending downwardly therefrom for simultaneous receipt within a respective passage, each said finger in its passage filling the space formed therein between the retention ledge and the opposite passagewall and forcing the protuberance and the medial portion of its associated terminal against the passage wall whereby to form an interference fit in the passage.

7. A connector assembly comprising a dielectric housing having a plurality of axial passages extending from a top face to a bottom face, an electrical terminal disposed within each said passage, and retention means for retaining the terminals within their respective passages, said retention means being characterized by each passage including a retention ledge extending from one towards the other opposite passagewall to define a reduced passageway, each said terminal including a medial portion having transverse cutout sized to seat about the respective retention ledge, and a terminal retention member including a plurality of fingers with each finger being sized to fill the reduced passageway and captivate the terminal relative to the retention ledge within each respective passage.

8. The assembly as recited in claim 7 wherein said retention member is of dielectric material and includes an elongated rail having a lateral face from which the fingers extend, the lateral face being adapted to seat on one end face of the connector housing with each said finger extending into its passage to form an interference fit between the passagewalls and the terminal thereby captivating the cutout about the retention ledge.

9. The assembly as recited in claim 7 wherein the said terminal is formed from a flat piece of conductive metal and the medial portion includes a protuberance, entry of each said finger into its respective passage simultaneously forcing the protuberance and the medial portion of its respective terminal against said one passagewall whereby to snugly interference fit each of the fingers and respective terminals within their respective passages.

10. The assembly as recited in claim 7, wherein each said terminal is axially extending and further comprising bias means for laterally biasing the medial portion of said terminal in a second direction perpendicularly of said first direction with respect to its passage.

11. The assembly as recited in claim 10 wherein the bias means comprises said terminal being L-shaped in cross-section and acutely angled.

12. A method of retaining a plurality of electrical terminals in a dielectric connector housing, said housing including a top face, a bottom face, and an array of axial passages extending between the faces, the steps of the method comprising forming on one passagewall of each passage a retention ledge the end face of which is spaced a predetermined distance from the passagewall opposite thereto, forming from a dielectric material a stuffer member comprising an elongated rail including a plurality of laterally spaced fingers, each said finger having a thickness about the same as said predetermined distance and each being laterally spaced by an amount defined by the distance between adjacent passages, forming a cutout at a medial portion of each terminal, the cutout having a configuration sized to fit about its retention ledge.

inserting each terminal into its respective passage and seating the cutout about the retention ledge, and mounting the stuffer member onto one face of the housing and causing each finger to be received in its respective passage, the finger interference fitting into the passage relative to the medial portion and the retention ledge.

13. The method as recited in claim 12, the steps of further including forming a protuberance on the medial portion of the terminal, and the mounting step causing each said finger to engage its associated protuberance whereby an interference fit is formed between opposite passagewalls, the finger and the terminal.

14. A method of completing an electrical interconnection between a duality of electrical cables and electrical terminals with each terminal being disposed in a respective axial passage extending through a dielectric housing, the housing having a flat top and bottom face and each terminal having a wire terminating end portion adjacent the top face, a mating end portion adjacent to the bottom face, and a medial portion, the steps characterized by stamping and forming the medial portion of each said terminal to include a cutout and a protuberance, constricting each passage with a retention ledge that extends from one to the other opposing passagewall, the ledge being dimensioned to receive said cutout and permit a reduced space to exist between the ledge and opposing passagewall, seating the medial portion of each terminal into its passage so that the cutout fits about the ledge, inserting each of a plurality of fingers extending from a common comb-like member into respective housing passageways whereby to form an interference fit therewithin between the passagewalls and the terminal with its protuberance, terminating the like end portions of the cables into respective terminating end portions so that like end portions one side-by-side, and strain relieving the termination by clamping and orienting the like side-by-side end portion of the cables, the orienting including causing the like end portions of the cables to describe a first and third cable portion disposed, respectively, in a first and third plane perpendicular to the passage axis, and a second and fourth cable portion disposed, respectively, in a second and fourth plane parallel to the passage axis, and the clamping including sandwiching an elongated first block between the first and third cable portions and placing an elongated second block downwardly against the third cable portion.

15. A connector having a strain relief arrangement for a plurality of coaxial cables each coaxial cable of the type having an elongate outer insulator jacket, a center conductor, and a drain conductor, the connector comprising a dielectric housing having a mating face, a terminating face, and an array of passages extending between the faces, a conductive contact disposed in each passage with each having a slotted mating end portion thereof protruding above said terminating face and terminated to a conductor of one said cable, said strain relief means characterized by a pair of L-shaped side walls, an elongated cover member, the plane of which being generally perpendicular to the array of axes defining said passages, a groove and a flange on one and the other said cover member and mating face with said flange being sized to fit within said groove whereby to position said cover member above the terminating face, and comb means operative between one and the other side wall and the lateral faces of the cover member for captivating respective insulator jackets therebetween whereby the respective cables extend perpendicularly to the terminating face and have their axes generally concentric with the passage of its respective contact.

16. The multi-contact connector as recited in claim 15 wherein the two conductors of each said cable are soldered within the respective slotted end portion of their respective contacts.

17. The multi-contact connector as described in claim 15 wherein each said passage opens on the terminating face with the locus of passage openings forming two linear rows, each of said rows being separated by the rib, the end portion of each said contact is slotted, and the center conductor and drain conductor of each respective cable are terminated to the slotted mating end of a first and a second contact.

18. The connector as recited in claim 17 wherein the each respective contact is retained in its passage in an interference fit as a result of a dielectric finger substantially filling the passage surrounding the contact.

* * * * *